United States Patent [19]

Kirkendall et al.

[11] 4,284,008

[45] Aug. 18, 1981

[54] DOUBLE RAMP DISCARDING SABOT

[75] Inventors: Richard D. Kirkendall, Havre de Grace; William H. Drysdale, Aberdeen; Louise D. Kokinakis, Fallston; Bruce P. Burns, Harford County, all of Md.

[73] Assignee: The United States of America as represented by the Secretary of the Army, Washington, D.C.

[21] Appl. No.: 29,188

[22] Filed: Apr. 12, 1979

[51] Int. Cl.[3] ..... F42B 13/16

[52] U.S. Cl. ..... 102/521; 102/203; 102/501

[58] Field of Search ..... 102/93, 32, 92.1

[56] References Cited

U.S. PATENT DOCUMENTS

| | | | |
|---|---|---|---|
| 3,000,316 | 9/1961 | Dunlap et al. | 102/93 |
| 3,107,615 | 10/1963 | Brady | 102/93 X |
| 3,111,902 | 11/1963 | Taylor | 102/DIG. 7 |
| 3,125,957 | 3/1964 | Lipinski | 102/93 X |
| 3,834,314 | 9/1974 | Young | 102/DIG. 7 |
| 3,899,978 | 8/1975 | Luther et al. | 102/93 |
| 4,187,783 | 12/1980 | Campoli | 102/93 |

*Primary Examiner*—Harold J. Tudor

*Attorney, Agent, or Firm*—Nathan Edelberg; Robert P. Gibson; Max Yarmovsky

[57] ABSTRACT

A segmented sabot utilizes a double ramp configuration and a centrally positioned obturating band in alignment with the center of gravity of an in-bore projectile to improve the uniformity of the shear traction forces at the interface between the sabot segments and a sub-caliber projectile, to reduce propellant gas blow-by and to enhance projectile in-bore and trajectory stability. The increased uniformity of shear traction forces between sabot and projectile interfaces and propellant gas self-sealing design permits a reduction in sabot weight of sufficient magnitude to increase the velocity of the projectile at the muzzle exit.

3 Claims, 6 Drawing Figures

DOUBLE RAMP DISCARDING SABOT

GOVERNMENTAL INTEREST

The invention described herein may be manufactured, used and licensed by or for the Government for governmental purposes without the payment to us of any royalty thereon.

BACKGROUND OF THE INVENTION

Various means have been used in the prior art to improve the performance of a projectile's lethality. Improvements in projectile lethality against armored vehicles and reinforced positions have been accomplished in some instances by use of a sabot which increases the projectile's velocity, accuracy and range. This improvement occurs in a sabot supported projectile because the bore area on which the gun pressure acts may be greatly increased with only a relatively small increase in total projectile weight. In addition there is improvement because the use of a small diameter flight body has less aerodynamic drag. To obtain optimum performance a sabot mass must be kept as low as possible while remaining within the constraints set by the structural requirements of the sabots.

Some of the problems with prior art discarding sabot designs have been related to increased propellant gas pressure and acceleration. The gas pressure and accelerating forces acting on prior art sabots usually generate stress fields with hoop or circumferential tension components. These stresses frequently cause splits between the sabot segments which prematurely vent the propellant gas. In prior art designs in order to prevent this leakage of gas, the gun tube was required to provide constraint until the opening of the sabot, and an additional structural seal was required to those areas exposed to the propellant gas pressure.

In sabot propelled projectiles, the propellant force acting on the surface of the sabot, is applied toward the acceleration of the subprojectile at the interface of the sabot and the subprojectile. The configuration of prior art sabots generally is such that this shear traction is very nonuniform along the axial dimension of the interface. This nonuniform shear traction is a very severe disadvantage in obtaining maximum load transfer in a fixed dimension device such as the bore diameter of a launch weapon.

Another problem with prior art sabot designs, especially prevelant in submunitions with large length to diameter ratios, is the in-bore and out-of-bore dynamic instability which causes the projectile to yaw. In the prior art, the rotating band or obturating band is generally located aft of the center of gravity of the full in-bore projectile. To counteract the high transverse loads generated by this inherent instability, additional boreriding support required for straightening and guidance must be made excessively rigid and heavy.

PRIOR ART STATEMENT

The applicant has reviewed U.S. Pat. No. 3,981,246 of Hans Werner Luther et al., and finds that the segmented sabot partially pertinent to the present invention. The patent of Luther et al. can be distinguished from the present invention in that it discloses the use of a single ramp saddle type sabot having rotating bands both aft and forward of the in-bore projectile's center of gravity. The single ramp saddle type sabot has a nonuniform shear traction interface between the sabot and the subcaliber projectile and requires heavy fore and aft boreriding supports.

SUMMARY OF THE INVENTION

The present invention relates to a segmented double ramp discarding type sabot for use on a subcaliber munition. The present invention is designed to use the high propellant gas pressure acting on a rear taper or ramp to constrict the sabot segments together and against the subcaliber projectile to form a simple high pressure gas seal with no additional weight penalty for accomplishing a good mechancial seal. The taper profile of both fore and aft ramp on the sabot is selected so that the shear traction between the sabot and the subcaliber projectile is uniform along an axial dimension under the ramps. An obturating band is disposed between the ramps in such manner that the center of gravity of the total in-bore projectile is located under the obturating band.

An object of the present invention is to provide a segmented sabot for use in firing a subcaliber projectile with improved lethality, accuracy and range.

Another object of the present invention is to provide a segmented discarding type sabot for firing a subcaliber projectile, wherein the sabot is insensitive to conditions of high secondary launch tube wear.

Another object of the present invention is to provide a segmented discarding type sabot having a fore and aft taper ramp profiles which are selected so that the shear traction between the sabot and the subprojectile is uniform along the axial dimension under the taper ramps to enable maximum force transfer to be made from the sabot to the subprojectile.

Another object of the present invention is to provide a sabot for a subcaliber projectible wherein the total load transfer for a fixed sabot length requires a lower maximum shear traction and allows a lighter, weaker sabot material to be utilized.

Another object of the present invention is to provide a sabot for a subcaliber projectile having an obturating band located between two tapered ramps over the in-bore projectile center of gravity to insure reduction in the transverse loads operating on the in-bore projectile because of yawing motions.

Another object of the present invention is to provide a lightweight sabot which is more efficient in launching a subprojectile which has a large length to diameter ratio.

Another object of the present invention is to provide a segmented discarding type sabot for a subcaliber projectile which uses the propelling pressure of a launch weapon to clamp the sabot segments together to prevent propellant gas leakage at joints between the sabot segments and the interface of the sabot and the subprojectile.

A further object of the present invention is to provide a segmented discarding sabot for a subcaliber projectile which has an obturating band operatively disposed over the center of gravity of the total in-bore projectile to insure increased dynamic stability during the munitions in-bore motion.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENT

Figure 1:
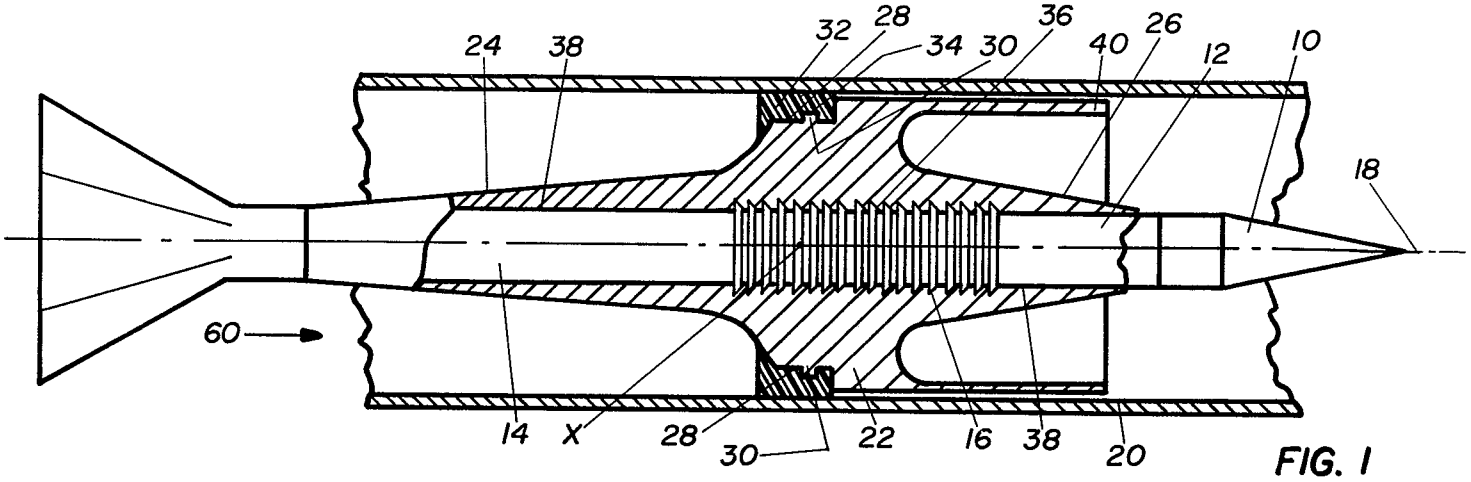
FIG. 1 is a partial dimetral cross-sectional view of a subcaliber projectile supported in a gun barrel by a segmented double ramp sabot having a cylindrical boreriding guidance member.
Figure 2:
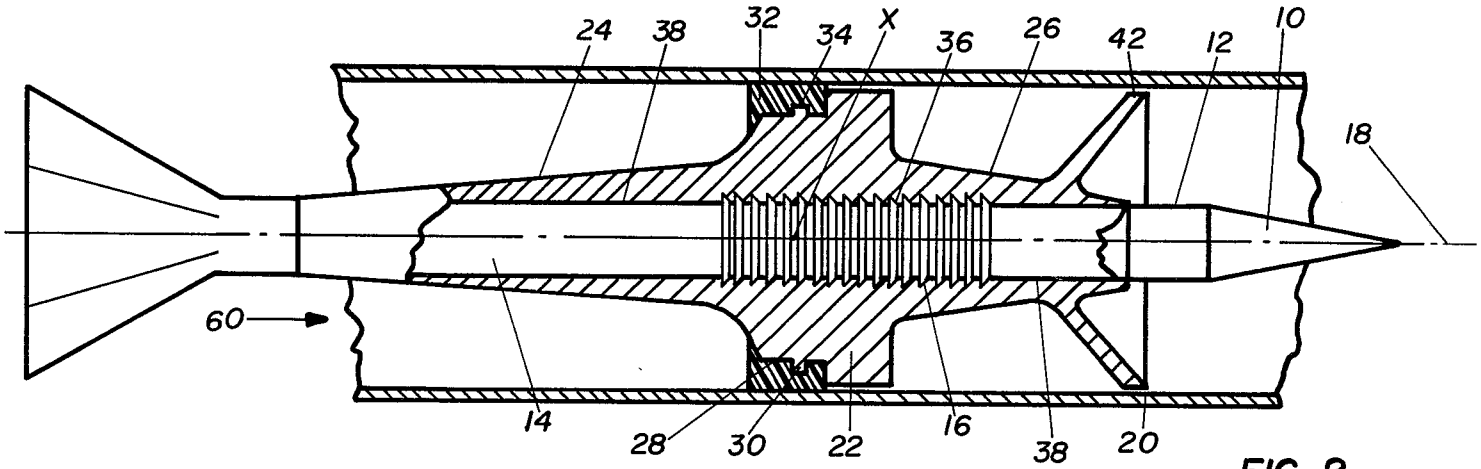
FIG. 2 is an alternate embodiment of FIG. 1 showing a conical shell boreriding guidance member.

Referring now to FIGS. 1 and 2 a fin stabilized subcaliber projectile 10 has cylindrically shaped smooth surface fore and aft body sections 12 and 14 respectively and a central externally grooved body section 16 disposed intermediate fore and aft body sections 12 and 14.

The longitudinal axis 18 of the subcaliber projectile 10 is held parallel to and in axial alignment with the longitudinal axis of a gun tube 20 by a plurality of sabot segments 22 which separate and discard after the subcaliber projectile 10 exits from the muzzle of gun tube 20. The profile of the sabot segments 22 comprises an aft tapered ramp surface of revolution section 24 and a forward tapered ramp surface of revolution section 26. Intermediate the aft ramp 24 and the forward ramp 26 is a cylindrical obturating band seat 28 having an annular band locking projection 30 thereon. An annularly shaped obturating band 32, having an annular groove 34 therein, made of a plastic material such material as nylon, is force fit over the sabot band seat locking projections 30 so that projection fits into band groove 34. The obturating band 32 is axially positioned so that the center of gravity at point "x" of the total in-bore saboted projectile lies on the centerline 18 of the sub-caliber projectile 10 within and under the obturating band 32. Each of the sabot segments 22 have internal concentric traction grooves 36 in a central section and are operatively disposed on an arcuate interface sabot surface 38 intermediate fore and aft ramps 26, 24 respectively.

To provide initial guidance for the in-bore projectile 10 during engraving and early motion, as well as small additional support through in-bore travel in gun tube 20, some form of borerider is required. A thin cylindrical skirt member, 40 arcuately extends over forward ramp 26, as shown in FIG. 1, and is used to perform this borerider function aforedescribed. A conical shell borerider member 42 extending from a forward end of forward ramp 26, as shown in FIG. 2, is an alternate means for performing this initial guidance function. The exact means of additional support is not important in the present invention, because there is no significant overturning movement generated by inertial forces which must be countered by a structurally strong borerider, thus boreriding surfaces or fins aft of the obturating band may be used. Since the transverse forces in the present embodiments of FIGS. 1 and 2 are smaller than found in conventional sabot-projectile configuration the borerider in the present invention may be made lighter than is normally required.

Figure 3A:
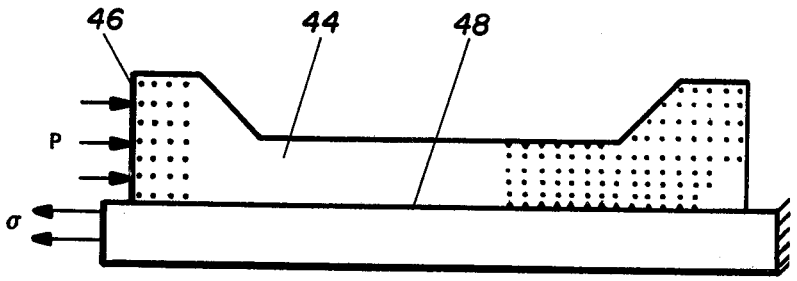
FIG. 3*a* is a schematic elevational view of a saddle back sabot.
Figure 3B:
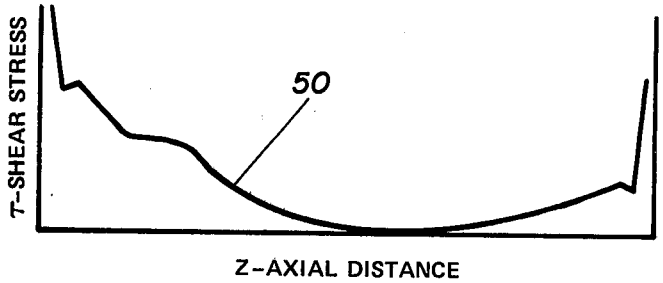
FIG. 3*b* is a plot of shear stress versus axial distance at the saddle-back sabot-subprojectile interface.
Figure 4A:
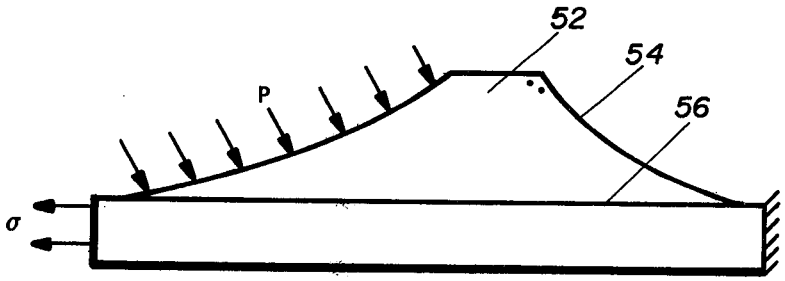
FIG. 4*a* is a schematic elevational view of a double ramp sabot.
Figure 4B:
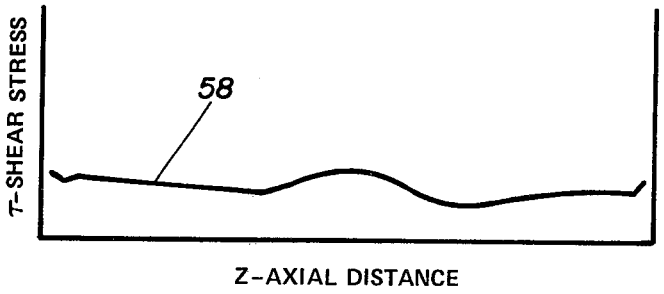
FIG. 4*b* is a plot of shear stress versus axial distance at the double ramp sabot-subprojectile interface.

The concept of double-ramp versus conventional saddle-back sabot configuration is illustrated by finite element analysis of two examples shown in FIGS. 3*a*, 3*b*, 4*a*, and 4*b*. Referring now to FIGS. 3*a* and 3*b* a conventional saddle-back type sabot segment 44 is shown with pressure forces "P" acting on the rear face 46 and penetrator axial stress "o" acting in the opposite direction. To illustrate the shear load transfer qualities, no acceleration will be imposed on this example. A method for calculating taper profiles to yield desirable characteristics may be found in the Proceedings of U.S. Army Science Conference, West Point, N.Y., 1978, "Sabot Design for 105 mm APFSDS Kinetic Energy Projectile", W. H. Drysdale et al. A dot is used in saddle-back sabot 44 to locate each element of the sabot that has a tensile hoop stress. Since a segmented sabot cannot support hoop tension, the seam must open in these regions. The areas of hoop tension form a path completely through the sabot, which would open to allow propellant gas to leak out. The variation in shear stress "$\tau$" at the sabot projectile interface 48 versus axial distance for the saddle-back sabot example is shown by curve 50. The result is very nonuniform, with peak values of shear stress indicated at both ends of the sabot and very low values in the center. This type of shear stress variation is conducive to domino failures, with shear grooves failing sequentially along the interface 50. When the same material and loading parameters are used to calculate the stess in a double-ramp sabot 52 versus axial distance a substantially uniform curve is generated as shown in FIG. 4*b*. Only two elements near the forward taper 54 of FIG. 4*a* had hoop tension. The sheer stress "$\tau$" variation at the interface 56 is ploted as curve 58, and is seen to be relatively uniform across the total axial interface distance Z.

In operation high pressure propelling gas pressure, as indicated by arrows 60 in FIGS. 1 and 2, acts on the aft tapered ramp surfaces of revolution 24 in such manner as to constrict the aft portion of the sabot 22 as well as providing propelling force to the sabot. The constricting action of the propellant gases clamp the sabot segments 22 tightly together and to the subprojectile 10 and act as an efficient high pressure seal in these areas. The propellant gas acting on the aft tapered ramp surfaces 24 creates very high compressive hoop and radial stresses. These stress are higher than the gas pressure, so there is no tendency for pressure to leak into the narrow slits between the sabot segments and to force them apart. The obturating band 32 also acts to prevent propellant gas leakage between the gun tube 20 and the peripheral bore riding surfaces sabots.

The propelling forces 60 acting on the sabots 22 are transferred to the subprojectile 10 across the interfaces 38 and interlocking concentric grooves 16 and 36. The maximum load transfer is best accomplished as previously stated when the interface traction is uniform in the axial direction and at its maximum allowable values. Factors affecting this load transfer are the gas pressure, projectile acceleration, subprojectile material and configuration, sabot material and configuration, and the profile of the sabot taper. On the interface 38, under the aft taper ramp 24, the constricting force of the gas pressure operating on surface 24, allows certain levels of load transfer to be accomplished by means of frictional forces. Since there is no substantial gas pressure acting on the forward ramp 26, the load transfer at the portion of this interface under ramp 26 must be accomplished by means of grooves, or threads. The sum of the interface lengths under the aft ramp 24 and of the length of concentric traction grooves 16 and 36 represents the total supported length of the subprojectile 10. This length is made sufficiently long to both adequately support the subprojectile 10 during in-bore travel and transmit the propelling force from the sabot to subprojectile.

In accordance with the present teaching the present invention makes it practical to obtain a lightweight sabot which can supply adequate axial and lateral support to launch high length to diameter ratio subprojectiles under high accelerations with improved leathality. Since the sabot weight is parasitic to the increased velocity and range obtainable from the concept of a sabot, the lightness of the sabot has a major impact on the efficiency of the projectile system.

While there has been described and illustrated specific embodiments of the invention, it will be obvious that various changes, modifications and additions can be made herein without departing from the field of the invention which should be limited only by the scope of the appended claims.

We claim:

1. A double ramp discarding saboted projectile which comprises:

a sub-caliber projectile having a cylindrically shaped fore body section, a cylindrically shaped aft body section, an externally grooved central body section disposed intermediate said fore and aft body sections, and a longitudinal axis;

a gun tube having a longitudinal axis in axial alignment with said longitudinal axis of said saboted projectile, said gun tube adapted for slidably supporting said saboted projectile therein during launch;

sabot means operatively connected to said sub-caliber projectile for preventing premature propellant gas leakage through said sabot means and through interface surfaces between said sabot means and said sub-caliber projectile, for propelling said saboted projectile through said gun tube with increased velocity, for obtaining uniform shear traction between the interface of said sabot means and said sub-caliber projectile, and for initial guidance of said saboted projectile through said gun tube which includes;

a plurality of double ramp sabot segments, each of said segments having an aft tapered ramp section having an internal cylindrical interface surface which mates with said aft body section of said sub-caliber projectile, a forward tapered ramp section having an internal cylindrical interface surface which mates with said forward body section of said sub-caliber projectile, an internally concentric traction groove section which mates with said groove central body section of said sub-caliber projectile, and borerider means for performing initial guidance during early motion of said sub-caliber projectile through said gun tube, wherein said aft and forward tapered ramp segment includes sabot segments having taper profiles designed to give an axially uniform load transfer between said interface surfaces;

an obturating band seat disposed intermediate said aft and said forward ramp sections, said obturating band seat having an annular band locking projection thereon;

a thin cylindrically shaped skirt arcuately extending over said forward tapered ramp section; and obturating band means fixedly connected to said sabot means and slidably disposed intermediate said sabot means and said gun tube, said band means positioned over the total in-bore center of gravity of said saboted projectile, for reducing the magnitude of transverse moments applied to said saboted projectile by yawing motions, for balancing said saboted projectile during in-bore travel through said gun tube, and for preventing leakage of propellant gases between said sabot means and said gun tube, said sabot means and said band means cooperating to eject said sub-caliber projectile from said gun tube with improved leathality and range.

2. An apparatus as recited in claim 1 wherein said obturating band means comprises an annularly shaped band made of material such as nylon, having an annular groove therein, said annular groove adapted to force fit over said annular band locking projection.

3. An apparatus as recited in claim 2 wherein said aft tapered ramp section includes sabot segments tapered to a degree when acted upon by propellant gas pressure, the pressure will cause a constricting force within said aft tapered ramp sections to clamp said plurality of sabot segments and said subcaliber projectile tightly together, giving an effective high pressure seal.

* * * * *